US009622517B2

(12) United States Patent
Hochman

(10) Patent No.: US 9,622,517 B2
(45) Date of Patent: Apr. 18, 2017

(54) FULL ZIPPERED GARMENT

(71) Applicant: Leon Hochman, West Bloomfield, MI (US)

(72) Inventor: Leon Hochman, West Bloomfield, MI (US)

( * ) Notice: Subject to any disclaimer, the term of this patent is extended or adjusted under 35 U.S.C. 154(b) by 0 days.

(21) Appl. No.: 14/800,161

(22) Filed: Jul. 15, 2015

(65) Prior Publication Data

US 2016/0015093 A1 Jan. 21, 2016

Related U.S. Application Data

(60) Provisional application No. 62/025,131, filed on Jul. 16, 2014.

(51) Int. Cl.
*A41D 1/06* (2006.01)

(52) U.S. Cl.
CPC ..... *A41D 1/065* (2013.01); *A41D 1/06* (2013.01)

(58) Field of Classification Search
CPC ..... A41D 1/06; A41D 13/02; A41B 9/02
USPC ..... 2/234, 79, 227, 219, 235, 78.2, 405, 408
See application file for complete search history.

(56) References Cited

U.S. PATENT DOCUMENTS 2,519,202 A * 8/1950 Slater ..... A41D 1/06 2/234
5,983,401 A * 11/1999 Ohara ..... A41D 1/06 2/227
6,161,223 A * 12/2000 Andrews ..... A41D 1/065 2/227
6,243,878 B1 * 6/2001 Khemka ..... A41D 1/065 2/227
6,941,584 B1 * 9/2005 Matthews ..... A41D 13/02 2/227
7,926,122 B1 * 4/2011 Countryman ..... A41D 1/06 2/227
8,881,314 B2 * 11/2014 McCombs ..... A41D 1/065 2/227

* cited by examiner

*Primary Examiner* — Tejash Patel
(74) *Attorney, Agent, or Firm* — The Weintraub Group, P.L.C.

(57) ABSTRACT

The present invention is directed to a full zippered garment having improved access to an inner undergarment worn by the wearer. Desirably, the flap located on the front of the pants provides the functions and the appearance of a normal pair of pants and use as a stain barrier thereat.

4 Claims, 2 Drawing Sheets

FULL ZIPPERED GARMENT

CROSS-REFERENCE TO RELATED APPLICATION

This application is a completion application of U.S. Provisional Application Ser. No. 62/025,131 filed Jul. 16, 2014 for "Full Zippered Garment" the entire disclosure of which, including the drawing, is hereby incorporated by reference.

BACKGROUND OF THE INVENTION

1. Field of the Invention

The present invention pertains to a full zippered garment with an easy access fly front opening that enables elderly patients and others having incontinence problems the ability to change or have easy access to an inner incontinence undergarment without having to remove pants and shoes.

2. Description of the Prior Art

In modern society, trouser-like garments are known and go by many different names, such as pants, jeans, and trousers and worn by men and women. In recent years, a special need has developed for individuals such as the elderly and others who have incontinence problems. One approach has been to provide adult diapers—also called undergarments. The undergarment may require the pants to be specially configured in a manner that the waist area is enlarged to accommodate the extra bulk of the undergarment. Some approaches have been suggested wherein the two pants legs are connected together by a single zipper that extends down and about the crotch and opens to allow the legs to separate from one another.

Partially opening of the zipper defines in part an openable fly front. However, the opening is typically limited and the opening is obstructed by a pant section or seam that extends downward from the waistband to the crotch area. The zipper is secured onto this pant section and the opening provided does not allow the user suitable access to the undergarment.

More seriously, the incontinent undergarment wearer may have an accident and need the ability to change the undergarment without having to disassemble or remove their pants, especially in situations when the wearer is not at home.

Some approaches to incontinence control have been suggested by the provision of undergarments with fly fronts. Desirably, providing trousers with a fly front opening that permits access to this undergarment would be desirable.

Prior approaches to garments that are separable into right and left halves for extra convenience or special needs for dressing and undressing in certain circumstances, or for adjusting the fit of the garment are illustrated by U.S. Pat. No. 6,161,223 to Andrews; U.S. Pat. No. 6,260,209 to St. Ange; U.S. Pat. No. 6,447,716 to Blair; U.S. Pat. No. 6,928,661 to Lewis; U.S. Pat. No. 7,926,122 to Countryman; U.S. Pat. No. 8,091,146 to Anhalt; and Patent publications 2006/0174399 to Nikolayer; and 2011/0167537 to Christoff.

Christoff is of interest and discloses pants with an invisible quick access opening wherein a single zipper extends from the front to provide an opening to the genital area, extends downwardly from a waistband at the front, under the crotch, and upwardly to terminate at the waistband in the rear, substantially separating the pant legs, if desired. Importantly, an inner seam or flap at the front underlies the zipper and extends substantially downwardly from the waistband to the crotch area, impeding access through an opening formed when the zipper opens the front of the pants.

Undesirably, for those with incontinence undergarments, extending the inner seam flap downwardly to the crotch obstructs the opening formed by the zipper. The wearer of such an undergarment would be impeded from reaching into the opening formed by the elongated zipper to attend to the undergarment, either to effect removal thereof, adjust the fitment, or manipulate a fly front undergarment when urination is needed.

There is a need for a zippered garment that provides a completely quick access opening that permits easy access to an inner incontinence undergarment such as for removal thereof. While useful for intended wearers such as women, the Christoff arrangement teaches against frontal access for use with incontinence garments.

The above publications are specifically incorporated herein by reference as regards the conventional approaches and constructions taught therein.

The devices and arrangements disclosed in the above listed publications are identified herein in recognition of the duty of disclosure of related subject matter, which may be relevant under 37 CFR 1.56.

SUMMARY OF THE INVENTION

The present invention is directed to a full zippered garment having improved access to an inner undergarment worn by the wearer, comprising a pair of pant legs joined at their top by a waistband, an elongated zipper, a center seam, an access opening along the center seam of the pants, the opening extending from the front waistband of the pants along the center seam of the front of the pants, through the center seam of the crotch and up the center seam of the rear of the pants to the rear waistband, the access opening being opened or shut using the elongated zipper, and an elongated zipper flap located in the front of one leg of the pants, the flap extending laterally from the seam of the one leg and downwardly from the front waistband along the seam, and terminating at a lower end spaced upwardly and away from the crotch, wherein partially opening the zipper creates a fly front access opening as needed and exposes the flap, the separation between the lower end of the flap and downward movement of the upper end of the zipper forming an unobstructed access opening between the lower end of the flap and the upper end of the zipper that provides the wearer with substantially unobstructed easy access to the inner undergarment.

Desirably, the flap located on the front of the pants provides the functions and the appearance of a normal pair of pants and use as a stain barrier thereat.

According to this invention, there is disclosed a full zippered garment comprising a right leg having a front section, a rear section and an upper edge, a second leg having a front section, a rear section and an upper edge, a waistband connected to the right leg and the left leg along the upper edges of the right leg and the left leg, an elongated zipper, the right leg connected to the left leg along the center seam and the zipper connected to form an invisible quick access opening extending along the center seam between the legs and openable by the elongated zipper from the waistband to the crotch between the legs, and an inner flap, the flap extending downwardly from the waistband in spaced relation to the crotch, the opening unobstructed by the flap to provide easy access to the inner undergarment.

According to this invention, there is disclosed a full zippered garment for use with an incontinence diaper, the garment comprising a waistband, pair of pant legs, the legs having front and rear sections and upper edges connected to the waistband, a zipper for connecting the legs together and creating an opening from the front section, through the crotch and to the rear section of the pants, an interior zipper flap located on one pant leg, the flap having a lower end dimensioned so that when the opening end of the zipper is moved downwardly and proximate to the crotch to form a partially open condition in the pants the lower end portion of the flap is exposed and the lower end thereof is spaced from the opening end of the zipper end proximate to the crotch to form a substantially unobstructed easy access opening below the flap to access the diaper.

According to this invention, for use with an incontinence undergarment, a full zippered garment, such as pants, jeans and trousers of the type having a pair of pant legs joined at their top to a waistband, a zipper located along a center seam that joins the pant legs together from the waistband through the crotch and to the front to form a fly front opening, and a protective interior flap that allows wearers to go to the bathroom without having to unfasten and remove the pants to access the incontinence garment, the flap being vertically spaced from the downward extension of the zipper to form an easy unobstructed access opening into the fly front for the wearer to access the undergarment.

The present invention will be more clearly understood with reference to the accompanying drawings and to the following Detailed Description, in which like reference numerals refer to like parts and where:

DETAILED DESCRIPTION OF THE PREFERRED EMBODIMENT

Figure 1:
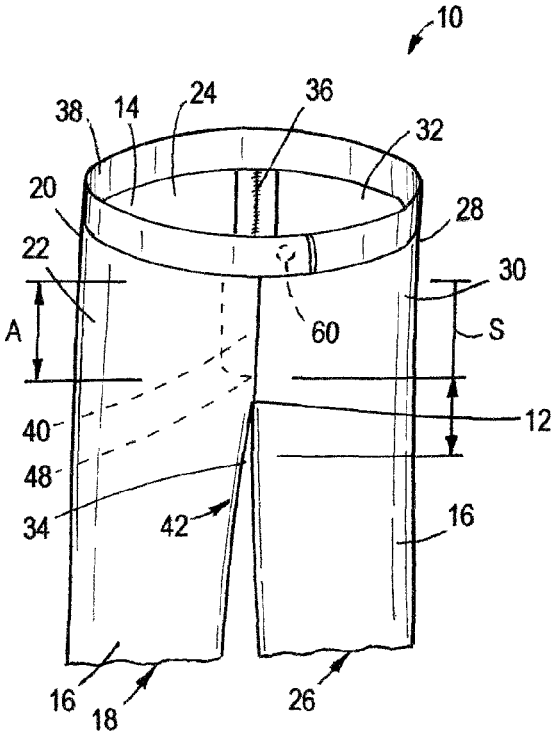
FIG. 1 is a front perspective view of a full zippered pair of pants of the present invention having a waistband and a quick access opening when in a closed position.

Turning now to the drawings, FIG. 1 shows a front perspective view of a full zippered pair of pants 10 of the present invention having a quick access opening 12 in a closed position. The pants 10 have an interior surface 14 and an exterior surface 16. A right leg 18 having an upper edge 20, a front section 22 and a rear section 24 is attached to a left leg 26 having an upper edge 28, a front section 30 and a rear section 32 along a center seam 34 via an elongated zipper 36. The right leg 18 and left leg 26 are also attached to a waistband 38 along the upper edges 20 and 28.

Conventional closure means 60 such as snaps, buttons, and the like secure front facing portions of the waistband into a closed position.

The zipper 36 has opposite sides 36*a*, 36*b* that join or separate to create an access opening 12 extending along the center seam 34 of the pants, the opening extending from the front waistband of the pants, through the crotch 42 of the pants and to the rear waistband. The access opening is formed (i.e., opened) or closed by moving a zipper slider 36*c* along the sides 36*a*, 36*b* of the zipper 36.

When in the closed position, the zipper 36 is not visible on the exterior surface 16 of the pants 10, thereby creating the appearance that the center seam 34 is a sewn seam and the appearance of a normal pair of pants 10. When the slider 36*c* of the zipper is moved downwardly and away from the front waistband 38 and the zipper sides 36*a*, 36*b* laterally separate downwardly from the waistband 38 and create a traditional fly front opening proximate to the crotch 42.

An interior zipper flap 40 is disposed on the interior surface 14 of the front section 30 of the pant leg 26, which as will be discussed, provides a protective layer beneath and against the front upper end portions of the zipper 36 and sides 36*a*, 36*b* thereof when closed and forms the "invisible" seam at the front sections 22, 30 of the pant legs 18, 26. When the pants are closed by the zipper 36, the flap 40 is disposed against the inner garment (not shown) to provide a protective moisture barrier to reduce the likelihood of accident stains from the inner incontinence garment being visible on the exterior surface 18 of the pants 10.

More importantly the zipper flap 40 cooperates with the zipper 36 to provide an enhanced, unobstructed, easy access opening 112 (FIG. 4) with the fly front opening of the pants 10 that enables the wearer to reach the inner incontinence garment, possibly to use the fly front opening of the pants 10 for normal purposes or to have enhanced but easy access to manipulate or even remove the inner undergarment from within the pants in the event of an accident.

Figure 2:
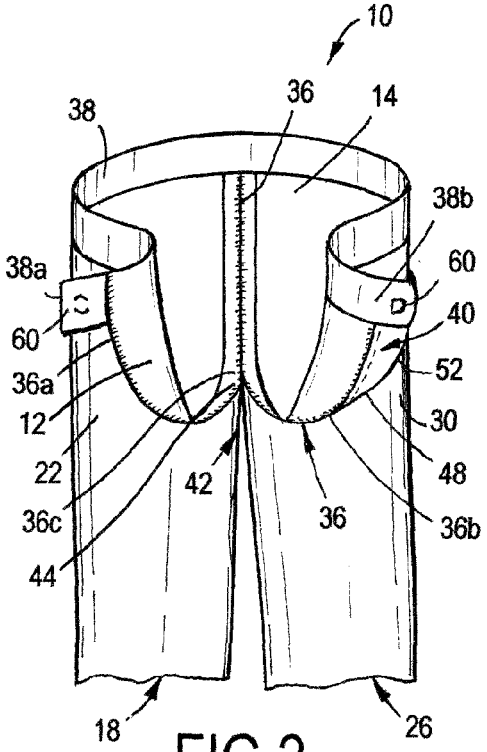
FIG. 2 is a front perspective view of the pair the of pants of the present invention and the quick access opening of the pants in an open position.

FIG. 2 is a front perspective view of the full zippered garment or pants 10 of the present invention wherein the zipper ends 36*a*, 36*b* and the fly front opening 12 is in a partially open position and the front ends 38*a*, 38*b* of the waistband 38 are in an open position. The elongated zipper 36 allows a wearer to create a front access opening 12 and, if desired, separate the two pant legs 18, 26 from the waistband 38 at the front sections 22, 30 downwardly around the crotch 42 and up to rear sections 24, 32 of the pant legs 18, 26 along the center seam 34. As shown, the zipper slider 36*c* has moved downwardly to the crotch 42, shown at 44, and laterally opened a portion of the zipper sides 36*a*, 36*b* of the zipper 36 and the front sections 22, 30 of the pant legs downwardly to the crotch 42. The downward lower end 48 of the zipper flap 40 is spaced upwardly and away from the downward extension 44 of the zipper slider 36*c* when creating a partial access opening 12.

Figure 3:
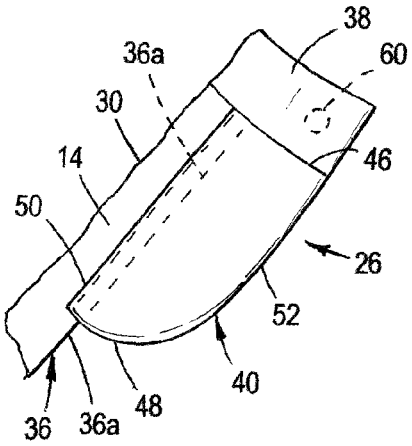
FIG. 3 is an enlarged portion of FIG. 2 showing an interior zipper flap and connection thereof to a pant leg.

Referring to FIG. 3, the interior zipper flap 40 is generally flat, rectangular in shape, and includes an upper and lower end 46, 48 and longitudinally extending inner and outer edges or ends 50, 52. The upper end 46 is joined to the waistband 38 and the lower end 48 of the flap 40 extends downwardly from the waistband to a location 54 on the seam spaced upwardly from the crotch 42. The inner end or edge 50 is joined with the inner surface 14 of the pant leg 26 and extends beneath and along the upper side 36*b* of the zipper 36 in a manner that the flap 40 projects outwardly and away from its securement to the pant leg 26. The flap and outer end 52 thereof will be disposed under and against the interior surface 14 of the other pant leg 18 when the zipper and waistband are closed. The flap 40 is sandwiched between the upper end of the zipper 36 and the inner incontinence garment of the wearer when the upper end portions 36*a*, 36*b* are closed by the slider 36*c*.

Importantly, the lower end 48 of the flap 40 extends downwardly from the waistband 38 to the location 54 on the center seam but is spaced upwardly and away from the crotch 42 and the zipper slider 36*c* when the fly opening 12 is open, the end 48 and slider location proximate the crotch defining a separation "S" therebetween. The separation defines an enhanced opening wherein the flap 40 does not obstruct the enhanced access opening 112 that is formed and permits ease of access to the wearer wanting to gain access to the inner incontinence garment.

Figure 4:
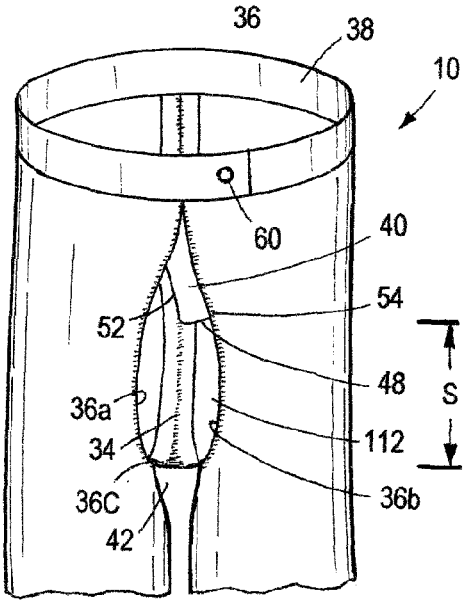
FIG. 4 is a front perspective view of the pair of pants of the present invention, the quick access opening and details of the zipper and the zipper flap to permit unobstructed access of the wearer through an enhanced opening thereof to reach an inner undergarment worn by the user.

FIG. 4 shows a front perspective view of the pants 10 of the present invention with the waistband 38 secured in a closed position and the fly front opening 12 forming with the flap 40 the enhanced quick access opening 112 in an open position for the wearer to have a substantially unobstructed access to the incontinence garment. The zipper slider 36*c* has moved downwardly and away from the waistband 38 and the zipper sides 36*a*, 36*b* laterally separated from the waistband to the crotch at 44, the upper end portions of the zipper sides 36*a*, 36*b* opening the front sections 22, 30 of the pant legs 18, 26 to form the fly front opening 12. The lower end 48 of the flap 40 is downwardly from the waistband 38 to the seam at 54. The slider 36*c* of the zipper 36, proximate to the crotch 42, is spaced downwardly and away from the downward extension of the lower end 48 of the flap 40.

When the zipper 36 is partially opened, downwardly to the crotch, an easy access opening 112 is formed below the lower end 44 of the flap 40 and above the crotch 39. Desirably, the flap 40 so dimensioned and positioned in the zipper opening does not inhibit user access to the undergarment.

Figure 5:
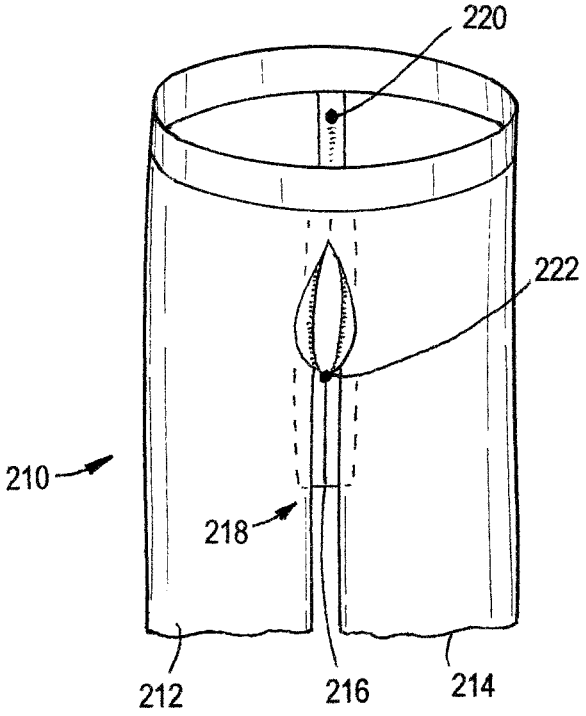
FIG. 5 is a view of a crotch portion second embodiment hereof.

Referring now to FIG. 5, there is depicted thereon an alternate embodiment hereof.

In accordance herewith, a pair of pants, generally denoted at 210 has legs 212, 214 a center seam 216, which extends from the front of the pant to the rear to define a crotch portion 218. A pair of zippers 220, 222 are disposed within the crotch area and extend from the front of the pant to the rear.

As is known to those skilled in the art to which the present invention pertains, the zippers may work in tandem and in relation to one another, or may be moved in opposing directions to provide one or two openings and to provide access to an under garment, or one adjacent to another to close off the entire seam, or to provide any other suitable opening.

In all other respects, the present invention is constructed the same as the first embodiment, including the flap 240.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

The invention claimed is:

1. A garment providing access to an inner undergarment worn by the wearer, comprising:

(a) a waistband having a front and a rear;

(b) a pair of pant legs having a front section, a crotch, and a rear section, the front section, the crotch, and the rear section each including an interior surface and an exterior surface, the pair of pant legs joined at their top by the waistband;

(c) a center seam extending along the front section, the crotch, and the rear section of the pair of pant legs;

(d) an elongated zipper moveable along the center seam;

(e) an access opening along the center seam of the pair of pant legs, the opening extending from the front of the waistband along the center seam of the front section of the pair of pant legs, through the center seam of the crotch, and up the center seam of the rear section of the pair of pant legs to the rear of the waistband, the access opening being opened or shut using the elongated zipper;

(f) an elongated zipper flap located on the interior surface of the front section of one leg of the pair of pant legs, the flap extending laterally from the center seam of the one leg and downwardly from the front of the waistband along the center seam, and terminating at a lower end spaced upwardly and away from the crotch, and wherein partially opening the zipper creates a fly front access opening as needed and exposes the flap, the separation between the lower end of the flap and downward movement of the upper end of the zipper forms an unobstructed access opening between the lower end of the flap and the upper end of the zipper that provides the wearer with substantially unobstructed easy access to an inner undergarment.

2. The garment of claim 1, wherein the flap located on the front of the pants defines a stain barrier.

3. The garment of claim 1, which further comprises a pair of zippers cooperating to improve access to an inner undergarment worn by the wearer, such that the degree of opening the garment may be regulated to permit only a partial opening along the seam while permitting the balance of the garment to remain closed.

4. A garment providing access to an inner undergarment worn by the wearer, comprising:

(a) a waistband having a front and a rear;

(b) a pair of pant legs having a front section, a crotch, and a rear section, the front section, the crotch, and the rear section each including an interior surface and an exterior surface, the pair of pant legs joined at their top by the waistband;

(c) a center seam extending along the front section, the crotch, and the rear section of the pair of pant legs;

(d) an elongated closure member moveable along the center seam;

(e) an access opening along the center seam of the pair of pant legs, the opening extending from the front of the waistband along the center seam of the front section of the pair of pant legs, through the center seam of the crotch, and up the center seam of the rear section of the pair of pant legs to the rear of the waistband, the access opening being opened or shut using the elongated closure member, (f) an elongated closure flap located on the interior surface of the front section of one leg of the pair of pant legs, the flap extending laterally from the center seam of the one leg and downwardly from the front of the waistband along the center seam, and terminating at a lower end spaced upwardly and away from the crotch, and wherein partially opening the closure member creates a fly front access opening as needed and exposes the flap, the separation between the lower end of the flap and downward movement of the upper end of the closure member forms an unobstructed access opening between the lower end of the flap and the upper end of the closure member that provides the wearer with substantially unobstructed easy access to the inner undergarment.

* * * * *